United States Patent [19]

Youmans

[11] 4,063,592

[45] Dec. 20, 1977

[54] SYSTEM FOR LOGGING HIGHLY DEVIATED EARTH BOREHOLES UTILIZING AUXILIARY SINKER BAR ASSEMBLY

[75] Inventor: Arthur H. Youmans, Houston, Tex.

[73] Assignee: Dresser Industries, Inc., Dallas, Tex.

[21] Appl. No.: 727,919

[22] Filed: Sept. 29, 1976

[51] Int. Cl.[2] ..... E21B 47/00

[52] U.S. Cl. ..... 166/67; 166/243

[58] Field of Search ..... 166/67, 65 R, 66, 178, 166/243; 267/136, 137, 139, 140, 125; 404/133

[56] References Cited

U.S. PATENT DOCUMENTS

| | | | |
|---|---|---|---|
| 1,530,552 | 3/1925 | Gilmore | 166/178 |
| 2,251,113 | 7/1941 | Chapman | 166/178 |
| 4,002,211 | 1/1977 | Holland | 173/87 |

*Primary Examiner*—James A. Leppink
*Attorney, Agent, or Firm*—William E. Johnson, Jr.

[57] ABSTRACT

A conventional logging instrument is adapted to traverse a slanted or deviated earth borehole on the end of a conventional logging cable. A heavy, streamlined sinker bar is adapted to be fitted over the cable and to slide freely thereon. Upper and lower stop clamps, separated by approximately 100 feet of cable, are provided on the cable with the lower stop clamp being located approximately 200 feet above the logging instrument. The sinker bar is adapted to slide freely between the upper and lower stop clamps. Since it is unlikely that the logging tool and the sinker bar will become stuck at the same time in a highly deviated borehole, one of two things can happen. If the sinker bar becomes stuck, the cable passes freely through the center of the sinker bar without impeding the logging tool until the upper clamp reaches the limit of its travel. If at that point the logging instrument is descending freely, it can dislodge the sinker bar with a gravitational force. If the logging instrument becomes stuck while the sinker bar is free, the sinker bar will rest on the lower clamp and push on the logging cable to impel it downward. By the concerted action of the sinker bar and logging tool, the probability of reaching greater depths within the deviated borehole is increased. A spring or other such shock absorber is affixed to each of the clamps to prevent transfer of excessive inertial force during the operation of the system.

4 Claims, 5 Drawing Figures

SYSTEM FOR LOGGING HIGHLY DEVIATED EARTH BOREHOLES UTILIZING AUXILIARY SINKER BAR ASSEMBLY

BACKGROUND OF THE INVENTION

This invention relates generally to a system for logging earth boreholes and specifically to a system which utilizes means to assist a well logging instrument to traverse highly deviated earth boreholes.

It has become relatively common within the last few years to drill wells in the search for oil and gas and the like with a portion of the well bore deviating from the usual vertical orientation thereof. The deviation or inclination may extend for a considerable distance at angles ranging to 70°, sometimes returning to the usual vertical orientation.

It is also well known in the art of drilling such wells to attempt the logging of the formations surrounding such boreholes with logging instruments run into the well bore on a wireline and/or a cable to perform various operations. Such tools usually depend upon the force of gravity to permit positioning of the well tool at the desired location in the well bore.

Another problem associated with such boreholes relates to the instability of some formations penetrated by the well bore, thus causing borehole diameter changes, some very abrupt. Ledges are formed, and the logging instrument frequently will lodge against them.

It is therefore the primary object of the present invention to provide a new and improved system for logging earth boreholes;

It is also an object of the present invention to provide a new and improved system for logging deviated boreholes in which it is very difficult to cause the well logging instrument to traverse the borehole simply by its own weight.

The objects of the invention are accomplished, generally, by a system which uses sliding weighted means on the cable above the well logging instrument to assist the well logging instrument in moving through such highly deviated earth boreholes.

These and other objects, features and advantages of the present invention will be apparent from the following detailed description taken with reference to the figures of the accompanying drawing, wherein;

FIG. 1 is a schematic view illustrating the drilling of a deviated earth borehole from an offshore platform;

FIG. 2 schematically illustrates a prior art well logging system encountering some of the problems associated with logging a highly deviated earth borehole;

Figure 1:
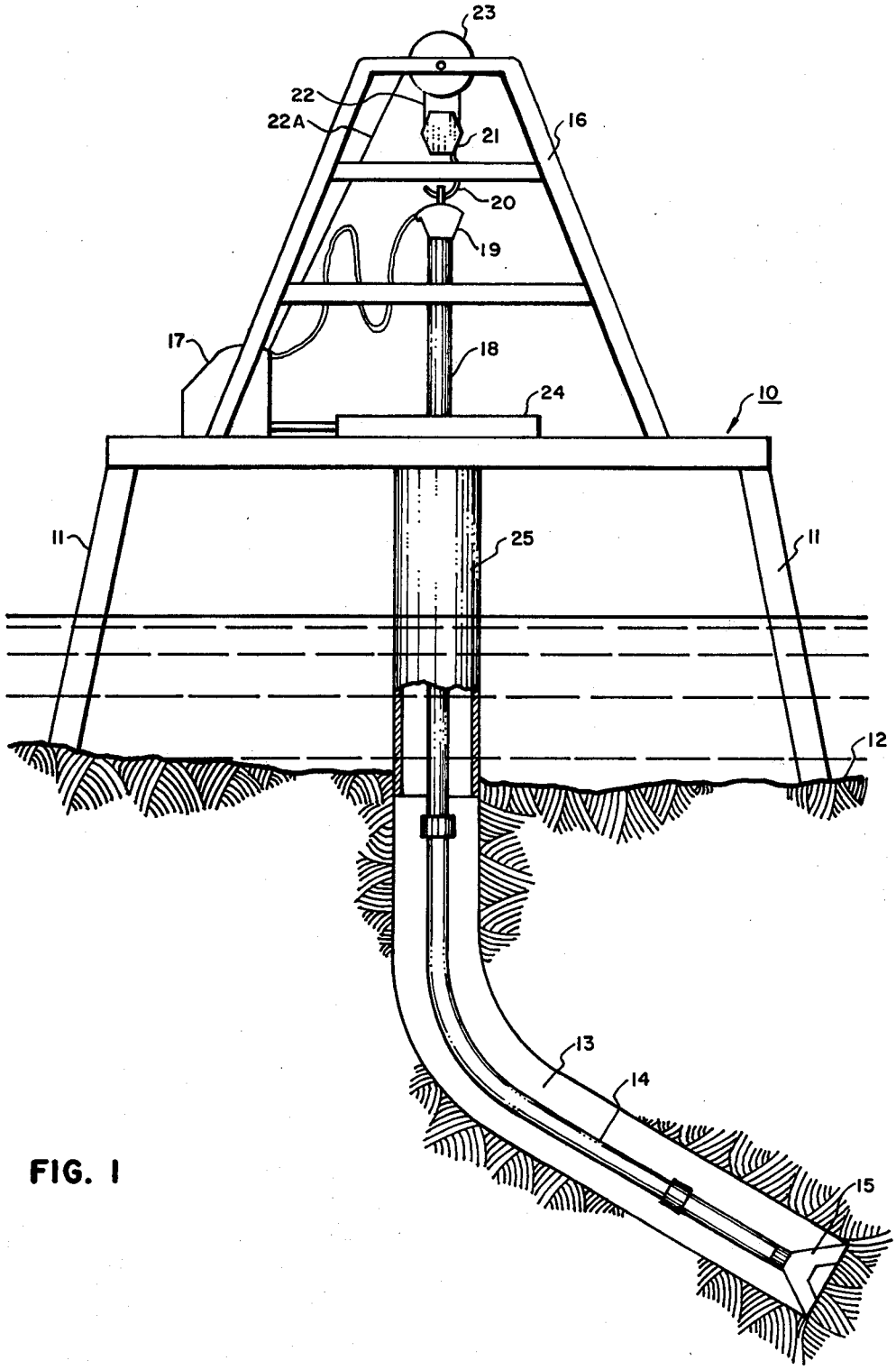

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled thereform. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks 17 also drive a rotary table 24 which in turn transmits the drive to the kelly 18. One end of the line 22, namely the fast line **22*a*, is connected to the drawworks 17 which contains the motor or motors for manipulating the drill string. Although not illustrated, the other end of the drill line 22** is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
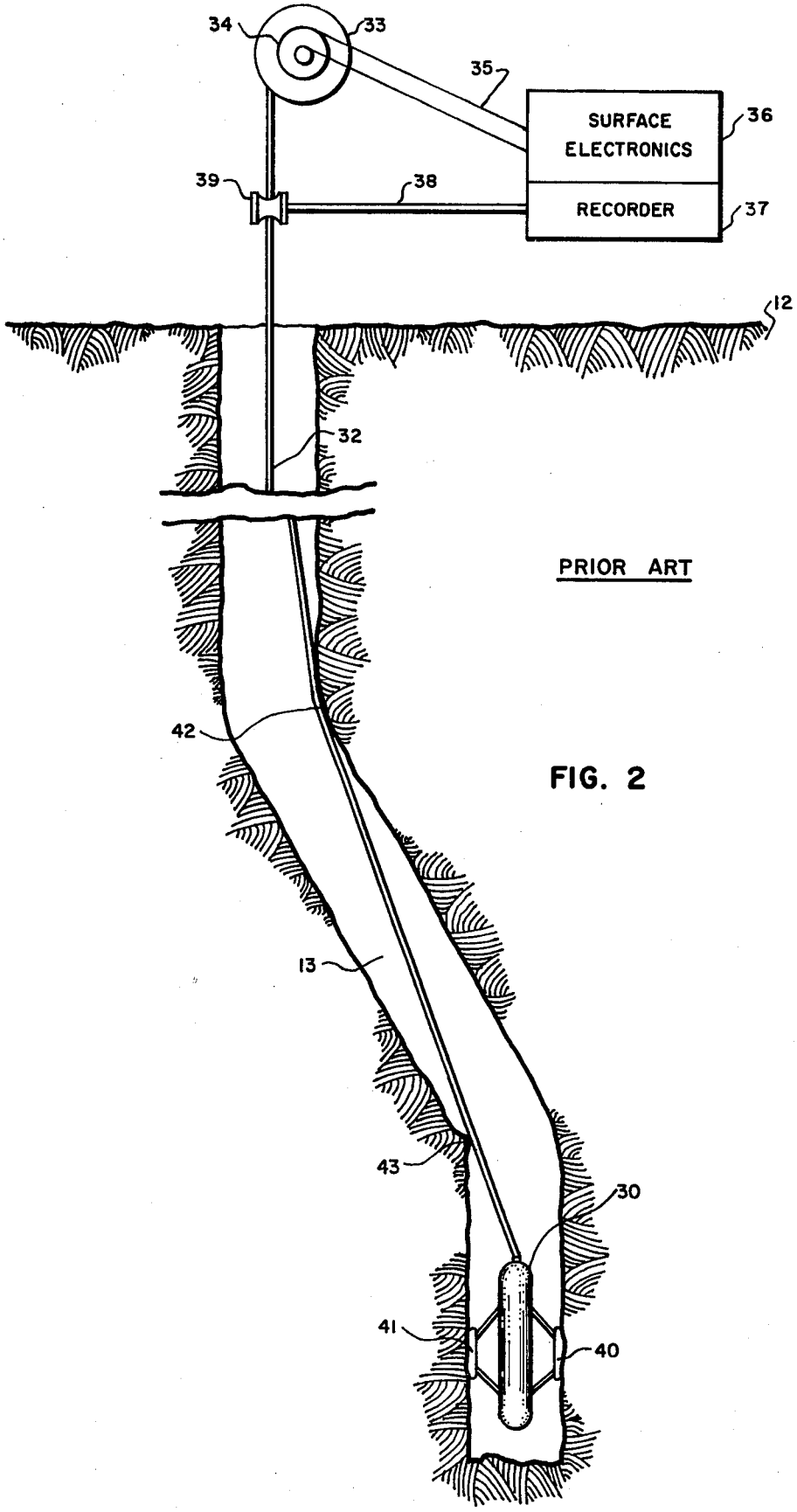

Referring now to FIG. 2, there is illustrated schematically a well logging operation conducted in accordance with the prior art in which a portion of the earth's surface 12 is shown in vertical section. A well 13, which has been drilled as illustrated in FIG. 1, penetrates the earth's surface. Disposed within the well is subsurface instrument 30 of the well logging system. The subsurface instrument 30 may be of any conventional type, for example, having a neutron source and detector as used in a radioactivity log. Likewise, the instrument 30 could be adapted to conduct an induction, electric, acoustic, or any other of the conventional logs well known in the art. It should be appreciated, moreover, that the particular type of well logging instrument 30 forms no part of the present invention.

Cable 32 suspends the instrument 30 in the well and contains the required conductors for electrically connecting the instrument 30 with the surface electronics. The cable is wound on or unwound from drum 33 in raising and lowering the instrument 30 to traverse the well. During the traversal, the signals from the well logging instrument 30 are sent up the cable 32. Through slip rings and brushes 34 on the end of the drum 33, the signals are conducted by the lines 35 to the surface electronics 36. A recorder 37 connected to the surface electronics 36 is driven through the transmission 38 by the measuring reel 39 over which the cable 32 is drawn, so that the recorder 37 associated with the surface electronics 36 moves in correlation with depth as instrument 30 traverses the well. It is also to be understood that instruments such as the instrument 30 are generally constructed to withstand the pressures and mechanical and thermal abuses encountered in logging a deep well.

As illustrated in FIG. 2, the instrument 30 has a plurality of measuring pads 40 and 41 adapted to engage the borehole walls but, as previously stated, the particular well logging instrument 30 forms no part of the present invention, and any conventional well logging instrument can be utilized as further explained hereinafter.

In the operation of the system illustrated in FIG. 2, the cable 32 is touching one ledge of the formation at the point 42 and another such ledge at the point 43, both of such ledges making it exceedingly difficult for the instrument 30 to traverse the earth borehole merely by its own weight due to the force of gravity. Furthermore, although not illustrated, the instrument 30 itself can easily become lodged against ledges such as the ledge 43 and any further descent becomes nearly impossible.

Figure 3:
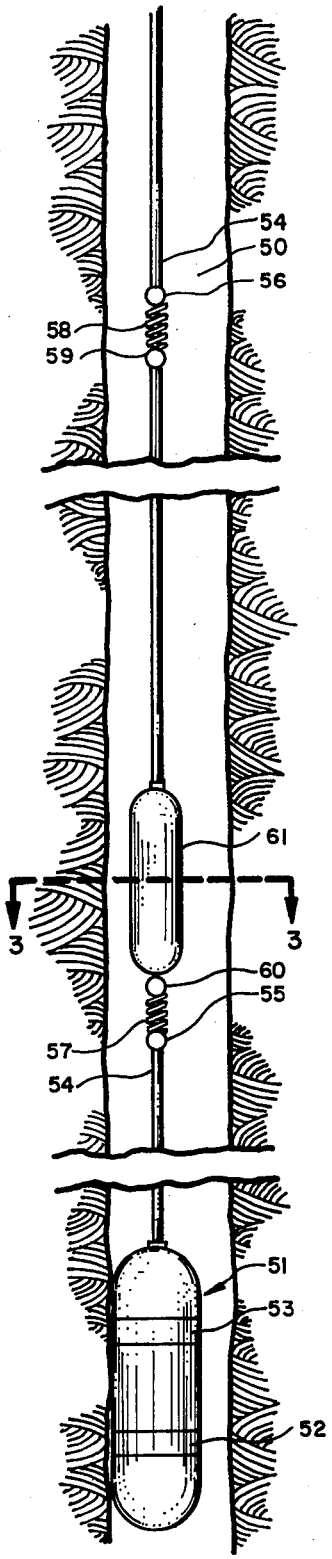
FIG. 3 is an elevated view, partly in cross section, of a portion of the system according to the present invention for logging an earth borehole.

Referring now to FIG. 3, there is schematically illustrated a portion of the system in accordance with the present invention for helping to facilitate the descent of a well logging unit into a deviated earth borehole. For ease of illustration in FIG. 3, borehole 50 is shown as being vertical but the further illustration, for example, in FIG. 5, demonstrates the utility of the system within a deviated borehole. Located within the borehole 50 in FIG. 3 is a conventional well logging instrument 51, for example, a radioactivity logging unit having a neutron source 52 and a detector 53. The instrument 51 is attached to a conventional well logging cable 54 which has a clamp 55 located some distance above the instrument 51, for example, 200 feet above the instrument 51. For purposes of illustration, the clamp 55 will be referred to hereinafter as the lower clamp. An upper clamp 56 is located some distance above the lower clamp, for example, the two clamps being separated by approximately 100 feet. The lower clamp 55 has a spring 57 attached thereto and through which the cable 54 passes. In a similar manner, the upper clamp 56 has a spring 58 attached thereto and through which the cable 54 passes. A ball-stop member 59 is attached to the lower end of the upper spring 58 and is fabricated to slide on the cable 54 as the spring 58 is compressed. In a similar manner, a ball-stop 60 is attached to the upper end of the spring 57 and is likewise adapted to slide along the cable 54 as the spring 57 is compressed.

Figure 4:
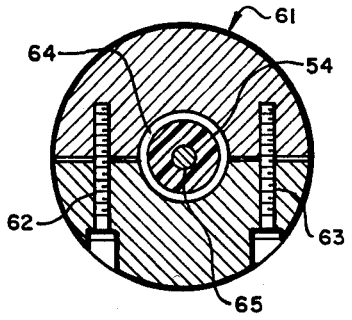
FIG. 4 is a cross-sectional view taken along the lines 3—3 of FIG. 3.

Located intermediate the clamps 55 and 56 is a streamlined, heavily-weighted sinker bar 61 which is adapted to fit over or around the cable 54 and to slide freely thereupon. As illustrated in FIG. 4, taken along the cross-sectional lines 3—3, the sinker bar 61 can, if desired, be in two sections bolted together around the cable 54, for example, by the bolts 62 and 63. Alternatively, if desired, the sinker bar can have a longitudinal slot therein to fit over the cable 54.

As illustrated in FIG. 4, the sinker bar 61 has a central longitudinal chamber 64 through which the cable 54 passes. The cable 54 is illustrated as being a single conductor cable having a central conductor 65 for ease of illustration. However, the cable 54 can be of any conventional type, for example, a multi-conductor cable well known in the art.

Figure 5:
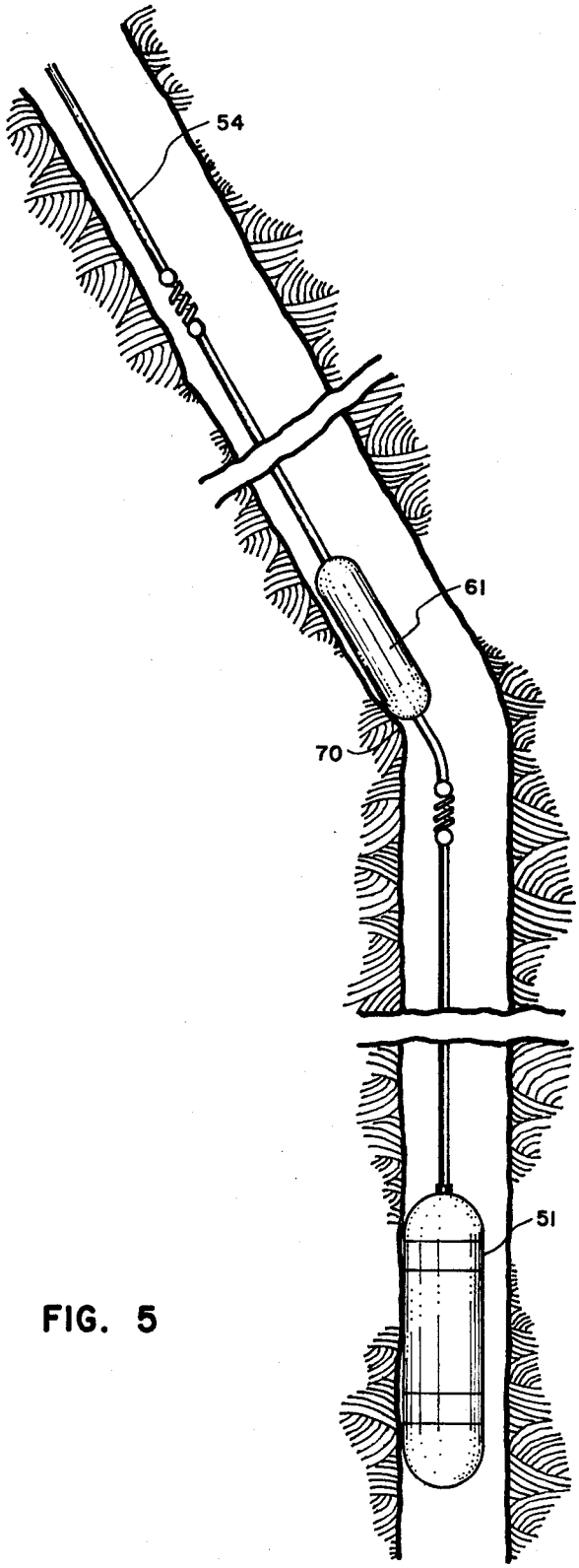
FIG. 5 schematically illustrates the operation of the system in accordance with the present invention while traversing a deviated borehole.

Referring now to FIG. 5, a system utilizing the sinker bar 61 in conjunction with the logging instrument 51 and its conventional cable 54 is illustrated as being used in a deviated borehole having a ledge 70 upon which the sinker bar 61 has become lodged.

It should be appreciated that the hoisting system illustrated in FIG. 2, including the surface electronics, recorder, hoisting drum, etc., can be used with the embodiments illustrated in FIG.'s 3–5.

In the operation of the system illustrated in FIG.'s 3, 4 and 5, it should be appreciated that whenever the sinker bar 61 does become stuck, for example, as illustrated in FIG. 5, the instrument 51 will frequently be in the unstuck position and its weight will cause the sinker bar 61 to pass on through the obstruction, for example, pulling it past the ledge 70 in FIG. 5. When the instrument 51 is stuck, and assuming that the sinker bar 61 is not stuck, the sinker bar 61 will be located as illustrated in FIG. 3 riding along the clamp 55 and its related spring 57 and ball-stop 60, thus pushing down with additional weight upon the instrument 51 to assist in pushing it through the deviated portion of the borehole.

It should be appreciated that that springs 57 and 58 help to lessen the inertial shock whenever the sinker bar 61 suddenly presses against either of the ball-stops 59 or 60. During the normal operation of the device, i.e., whenever the sinker bar is resting against the ball-stop 60, it is especially helpful to have the lower part of the cable 54, i.e., between the clamp 55 and the well logging instrument 51, to be of an enlarged diameter so as to increase its stiffness coefficient and thus effectively push down against the well logging instrument 51.

Thus there has been illustrated and described herein the preferred embodiment of the present invention wherein means are provided to assist the descent of a well logging instrument through a highly deviated borehole, whether being located off-shore or onshore. However, modifications to the preferred embodiment will be obvious to those skilled in the art from a reading of the foregoing detailed description. For example, the sinker bar can be sized, both as to weight, diameter and length, depending upon the size of the borehole and the conditions expected to be encountered. In most cases, however, the sinker bar 61 should weigh several hundred pounds to facilitate the movement of the instrument 51 through the borehole. Furthermore, additional clamps can be placed on the cable if desired and additional sinker bars placed therebetween, thus resulting in a plurality of sliding sinker bars being used in a system as contemplated by the present invention. In addition, the sinker bar can be other than streamlined if desired, for example, having wheels, rollers or other such means making it easier to traverse the borehole. Furthermore, although ball-like clamping means are illustrated in the preferred embodiment, other forms of stop means can be utilized to limit the movement of the sinker bar between two points on the cable. As an alternative embodiment, although not as efficient, the lower of such stop means can be coincident with the top of the instrument 51.

The embodiments of the invention in which an exclusive property or privilege is claimed are defined as follows:

1. A system for logging earth boreholes, comprising:
an elongated well logging instrument adapted to traverse an earth borehole;
a cable leading from the earth's surface attached to said instrument;
hoist means at the earth's surface for winding and unwinding said cable to thereby enable said instrument to traverse said earth borehole;
means slidably attached to said cable and adapted to traverse said earth borehole; and
first and second stop means on said cable intermediate the said hoist means and the said logging instrument and on opposite sides of said slidable means, thereby limiting the sliding movement of said slidable means.

2. The system according to claim 1, wherein at least one of said stop means includes shock absorber means.

3. The system according to claim 1, wherein each of said first and second stop means includes shock absorber means.

4. The system according to claim 1, wherein each of said first and second stop means is some distance removed from the said logging instrument.

* * * * *